United States Patent [19]

Kagiura et al.

[11] Patent Number: 4,896,193

[45] Date of Patent: Jan. 23, 1990

[54] MULTICOLORED IMAGE FORMING APPARATUS SEPARABLE FOR EASE OF MAINTENANCE

[75] Inventors: Kazuo Kagiura, Tokyo; Noriyuki Yokoo, Hiratsuka; Mototada Toriumi, Tokyo; Hiroyoshi Maruyama; Hidetoshi Tanaka, both of Yokohama; Yoichi Ishii, Tokyo, all of Japan

[73] Assignee: Canon Kabushiki Kaisha, Tokyo, Japan

[21] Appl. No.: 332,383

[22] Filed: Apr. 3, 1989

Related U.S. Application Data

[63] Continuation of Ser. No. 928,419, Nov. 10, 1986, abandoned.

[30] Foreign Application Priority Data

Nov. 15, 1985 [JP] Japan ..... 60-255000
Jun. 9, 1986 [JP] Japan ..... 61-133189

[51] Int. Cl.[4] ..... G03G 15/01

[52] U.S. Cl. ..... 355/326; 355/245; 355/296

[58] Field of Search ..... 355/200, 245, 326, 296

[56] References Cited

U.S. PATENT DOCUMENTS 3,854,449 12/1974 Davidson .
4,591,261 5/1986 Saruwatari et al. .
4,615,605 10/1986 Kida et al. ..... 355/245 X
4,619,516 10/1986 Iwai .
4,619,518 10/1986 Kameyama et al. .
4,655,579 4/1987 Adachi et al. .
4,668,076 5/1987 Iseki et al. .
4,705,394 11/1987 Watanabe ..... 355/245
4,710,016 12/1987 Watanabe ..... 355/326

FOREIGN PATENT DOCUMENTS 159721 10/1985 European Pat. Off. .
3504939 8/1985 Fed. Rep. of Germany .

*Primary Examiner*—Patrick R. Salce
*Assistant Examiner*—Emanuel Todd Voeltz
*Attorney, Agent, or Firm*—Fitzpatrick, Cella, Harper & Scinto

[57] ABSTRACT

An image forming apparatus comprising a first body and a second body which are openable or separable from each other. The apparatus contains a plurality of developing devices, each of which is movable between its developing position for developing a latent image on an image bearing member of the image forming apparatus and a retracted position where the developing device is retracted from the developing position. At least the developing device that is located at its developing position when the apparatus is closed, is moved away from the image bearing member in response to an operation for opening the second body relative to the first body.

29 Claims, 11 Drawing Sheets

MULTICOLORED IMAGE FORMING APPARATUS SEPARABLE FOR EASE OF MAINTENANCE

This application is a continuation of application Ser. No. 928,419, filed Nov. 10, 1986, now abandoned.

FIELD OF THE INVENTION AND RELATED ART

The present invention relates to an image forming apparatus such as an electrostatic printing apparatus, an electrophotographic copying apparatus and a laser beam printer. More particularly, the invention relates to an image forming apparatus wherein a plurality of developing devices are disposed around an image bearing member, and the developing devices are movable toward the image bearing member so that the image on the image bearing member can be selectively developed by one of those developing devices containing different color developers, for example.

Recently, an image forming apparatus such as an electrophotographic copying apparatus has been put into practice that is capable of producing an image in red, blue, green or another color as well as in black.

An apparatus of this type is known wherein developing devices containing different color developers are prepared and are made selectively mountable into the image forming apparatus in accordance with the desire of the operator who can interchange the developing devices.

On the other hand, the recent image forming apparatus is capable of effecting an automatic duplex or superimposing image formation, in which the image forming apparatus is equipped therein with a plurality of developing devices containing different color developers, which can be selected by the operator by depressing a selector button in its operation panel so as to permit a color copying in a desire color or colors. In this apparatus, images of different colors can be formed on a single sheet. In this type of the apparatus, a proposal has been made wherein not all of the developing devices are interchangeable. More particularly, the developing device containing the black toner which is most frequently used is not made interchangeable whereas the developing device containing another color toner such as red, blue or green is made interchangeable so that the operator can select the non-black color developing device. In any type of the apparatus capable of accepting an interchangeable developing device, it is desirable that the interchanging operation is simple and easy.

In addition, an image forming apparatus has been proposed wherein its image bearing member is replaceable with respect to the main body of the image forming apparatus so that the user can replace the image bearing member with a fresh one when the previous image bearing member is worn out.

However, when the user attempts to mount or demount the developing device or the image bearing member while the developing device takes a position wherein it performs the developing operation, it is possible that the image bearing member is damaged by the mounting or demounting action.

On the other hand, a shell (bivalve)-type image forming apparatus is known wherein the apparatus is separable or openable into upper and lower bodies about an axis, in which they are separable along a sheet transportation passage in order to increase the easiness of maintenance operations to dispose of a jammed sheet or the like. In this apparatus, even when the sheet is jammed in the apparatus, the sheet can be easily taken out because the sheet transportation passage is opened simply by opening or separating the bodies. In the image forming apparatus of this structure, the developing device and/or the image bearing member is replaced while the bodies are separated. There still is the problem that the image bearing member may be damaged when the mounting or demounting operation is carried out at the time when the developing device or devices are placed in the developing position or positions.

SUMMARY OF THE INVENTION

Accordingly, it is a principal object of the present invention to provide an image forming apparatus wherein the developing device and/or the image bearing member can be interchanged or replaced easily.

It is another object of the present invention to provide an image forming apparatus capable of being separable into two bodies, wherein the developing device and/or the image bearing member can be replaced or interchanged without difficulty.

It is a further object of the present invention to provide an image forming apparatus wherein the image bearing member is protected from the possible damage when the developing device and/or the image bearing member is replaced or interchanged.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
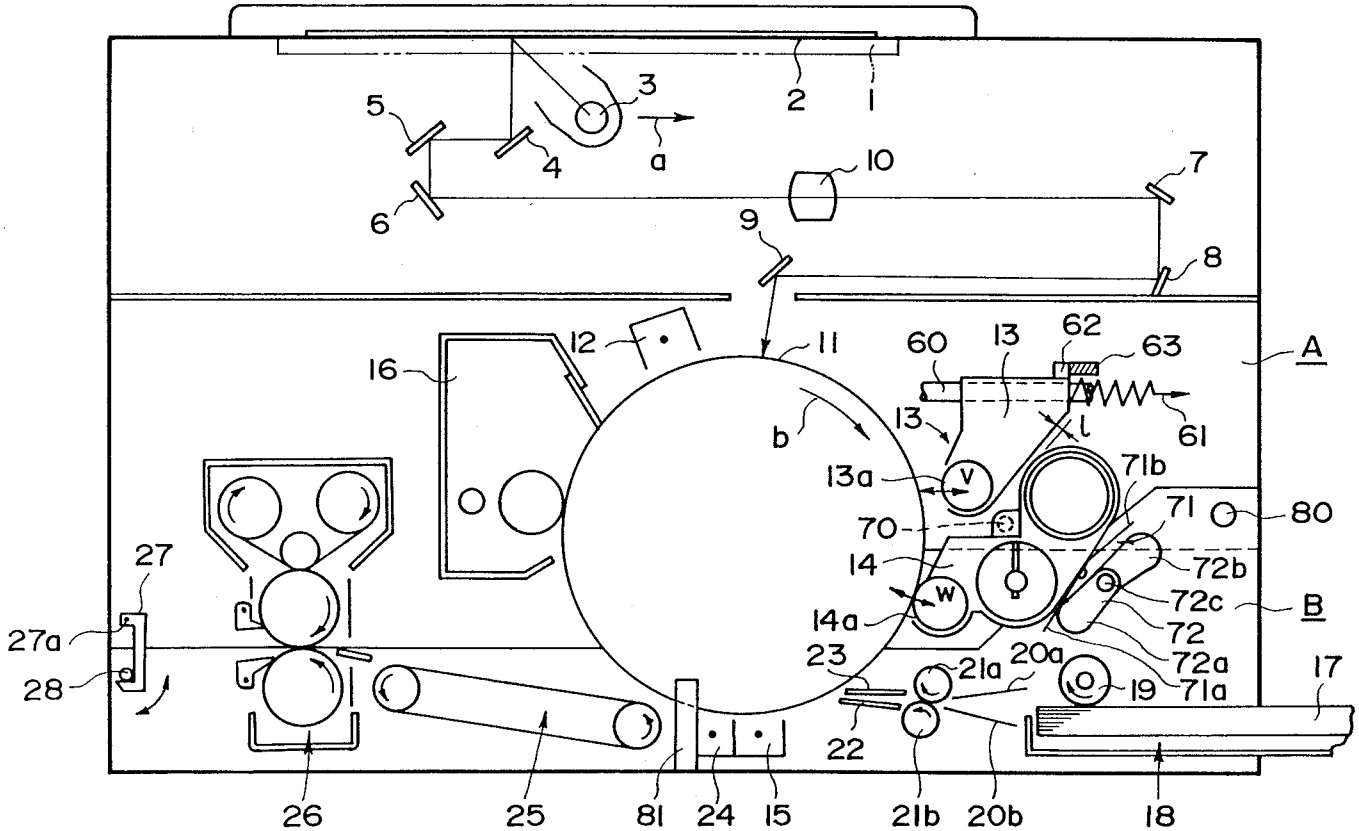
FIG. 1 is a sectional view of an image forming apparatus according to an embodiment of the present invention.

Referring to FIG. 1, there is shown an image forming apparatus according to an embodiment of the present invention. The exemplary image forming apparatus is shown as a two-color electrophotographic apparatus. In this apparatus, an original 2 supported on an original supporting glass 1 is illuminated by a lamp 3 to produce a light image, which is introduced to an image bearing member which is a photosensitive drum 11 in this embodiment, by way of reflecting mirrors 4, 5, 6, 7, 8 and 9 and a lens 10, which constitute an optical system. The lamp 3 and the mirrors 4, 5 and 6 scan the original 2 at a predetermined speed in the direction of an arrow a.

On the other hand, the photosensitive drum 11 rotating in a direction indicated by an arrow b is uniformly charged by a charger 12, and thereafter, it is exposed to the light image, so that an electrostatic latent image is formed thereon in accordance with the original image.

In this embodiment, the image forming apparatus is of such a type wherein the photosensitive drum is first uniformly charged and then exposed to the light image, resulting in the formation of an electrostatic latent image. However, it is understood that the present invention is applicable to another type of image forming apparatus, a laser beam printer, for example, wherein image information is received from an external apparatus and is transduced to light signals which are applied to the photosensitive drum so as to form an electrostatic latent image in accordance with the image information.

The image forming apparatus according to this embodiment further includes a color (non-black) developing device 13 (a second developing device) containing a color developer (red, blue, green or the like, for example) and a black developing device 14 (a first developing device) containing a black toner, both of which are disposed in the vicinity of the surface of the photosensitive drum 11. Those developing devices 13 and 14 are movable in the respective directions V and W. More particularly, they are movable between their developing positions wherein the latent image on the photosensitive drum 11 is developed thereby and their retracted positions where they are away from the developing positions. A selected one of the developing devices is moved to and held at the developing position to provide an image in the desired color, so that the electrostatic latent image on the photosensitive drum 11 is visualized. In FIG. 1, the developing device 13 is away from the photosensitive drum 11, while the developing device 14 is close to the photosensitive drum 11. Therefore, the latent image can be developed by black toner in the state shown in FIG. 1.

On the other hand, the transfer sheet 17 can be supplied in any one of known supplying manner. In this embodiment, the transfer sheets are contained in a cassette 18 and are fed one by one by a pick-up roller 19, guides 20*a* and 20*b* to a couple of registration rollers 21*a* and 21*b*. The transfer sheet 17 fed to the registration roller couple is fed to a photosensitive drum surface along transfer sheet guides 22 and 23 at such timing that the developed image on the photosensitive drum 11 and the transfer sheet 17 are aligned.

The transfer sheet 17, opposed to the photosensitive drum surface, receives the image from the surface of the photosensitive drum under the action of a transfer charger 15, and thereafter, is separated from the surface of the photosensitive drum by a separation charger 24. Then, the transfer sheet is transported along the transportation passage 25 to an image fixing device 26, where the image on the transfer sheet is fixed into a permanent image thereby. Finally, the transfer sheet 17 is discharged out of the apparatus.

The photosensitive drum 11, after the image transfer to the transfer sheet, is subjected to a cleaner 16 by which the toner remaining on the surface of the photosensitive drum is removed. Subsequently, the photosensitive drum is exposed to light by exposure means, so that the electric charge remaining thereon is removed, whereby the photosensitive drum is ready for the next image forming operation.

Figure 2:
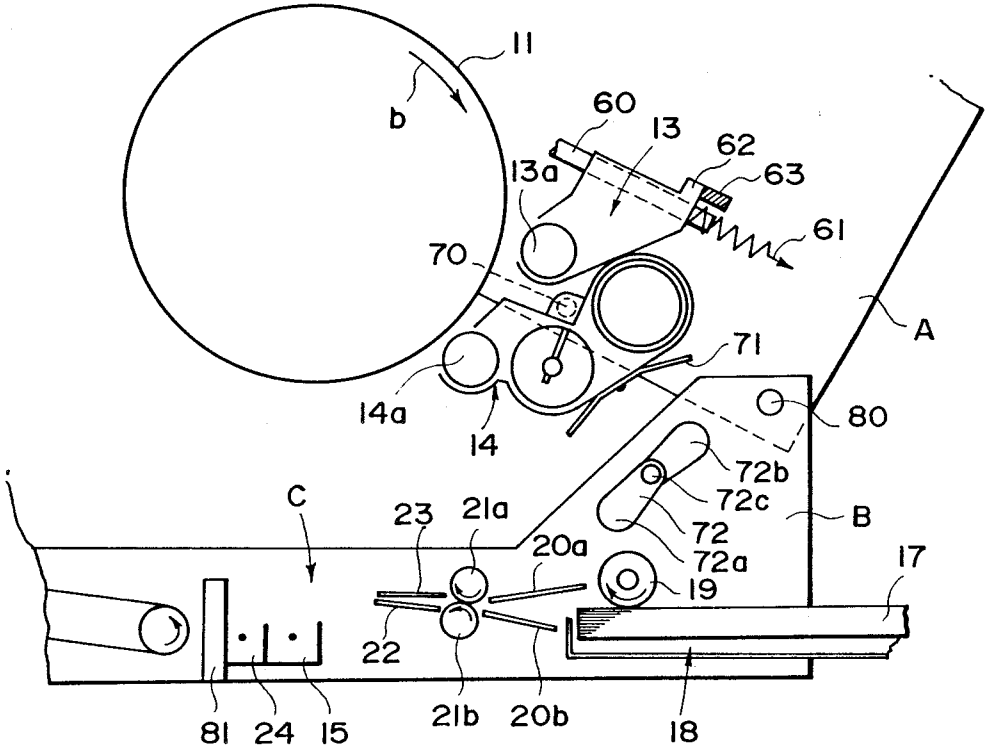
FIG. 2 is a partial sectional view of the apparatus of FIG. 1 when a part of the body is opened.

The copying apparatus according to the present invention includes an upper body A and a lower body B. The upper body contains the original supporting glass 1, the lamp 3, the optical system constituted by the elements 4, 5, 6, 7, 8, 9 and 10, the photosensitive drum 11, the charger 12, the developing devices 13 and 14 and the cleaner 16 and other means. The lower body B contains the transfer sheet supplying system 18, 19, 20*a* and 20*b*, the transporting system 21*a*, 21*b*, 22, 23 and 25, the transfer charger 15, the separation charger 24 and the image fixing device 26 and other means. The upper body A is rotatable or pivotable about a shaft 80 with respect to the lower body B. In FIG. 1, the upper body A is closed, whereas in FIG. 2, the upper body A is opened. In FIG. 2, the upper body A is shown as containing the photosensitive drum 11 and the developing devices 13 and 14, and the lower body B is shown as containing the sheet feeding system, a part of the sheet transportation system, the transfer charger 15 and the separation charger 24. The other means and elements are omitted for the sake of simplicity. In the state shown in FIG. 1, the upper body A and the lower body B are locked by locking means 27, thus preventing the upper body A from unintentionally opening. The locking means 27 is rotatable in a direction indicated by an arrow about a shaft 27*a*, and in FIG. 1, it is engaged with an engaging portion 28 of the lower body B. When the locking engagement between the locking means 27 and the engaging portion 28 is released, the upper body A is opened by an action of an urging means such as a spring, and is held in the state shown in FIG. 2, thus opening the transfer sheet transporting passage C.

Each of the developing devices will be further described.

The developing device 13 contains non-black color toner, such as red, blue, green or another, in this embodiment. The developing device 13 is slidably supported on a guiding rod 60 fixed to a frame of the apparatus. It is normally urged by an urging means such as a spring 61 in such a direction that the developing sleeve 13*a* thereof is away from the surface of the photosensitive drum 11. The tendency of movement of the developing device 13 in that direction is restricted by a stopper 63 engaged with a projection 62 of the developing device 13.

The developing device 14 which contains the black toner is swingably supported about a pin 70 mounted to the frame of the apparatus in a known manner. On the rear side of the developing device 14, there is a leaf spring 71 mounted thereto. In the state shown in FIG. 1, the copying operation using the black toner is selected. In this state, a pressing cam 72 rotates in the clockwise direction about a shaft 72c, whereby an end 72a of the pressing cam 72 urges an end 71a of the leaf spring 71 so as to rotate the developing device 14 about the pin 70. By this, the developing device is moved toward the photosensitive drum 11 so that the developing sleeve 14a assumes its developing position, thus enabling the black toner development. At this time, the color developing device 13 is acted on by the spring 61 so that the retracted position where the developing device 13 is taken, whereby the developing sleeve 13a is away from the surface of the photosensitive drum 11. In this embodiment, when the developing device 13 assumes the retracted position, the developing operation of the developing device 13 is not performed.

When the copying operation using the color toner is selected (FIG. 3) the pressing cam 72 rotates in the counterclockwise direction about the shaft 72c, so that an end 72b thereof urges the other end 71b of the leaf spring 71 of the black toner developing device 14, thus rotating the black developing device 14 in the counterclockwise direction about the pin 70. This rotation moves the developing sleeve 14a of the developing device 14 away from the photosensitive drum 11. In this manner, the developing device 14 is pushed away from the developing position to the retracted position so as to prevent the black toner from depositing onto the photosensitive drum 11.

Similarly to the developing device 13, the developing device 14 does not perform the developing action when it takes the retracted position.

When the black developing device 14 rotates by the action of the pressing cam 72 in the counterclockwise direction, an upper end 14b of the black developing device engages to the rear wall of the color developing device 13 so as to move the color developing device 13 toward the photosensitive drum 11 against the spring force of the spring 61. By this, the developing sleeve 13a of the developing device 13 becomes close to the photosensitive drum 11, whereby the developing device 13 takes the developing position.

The above described movements of the developing devices are carried out in response to a selecting operation by the operator. The above described rotation of the pressing cam 72 is effective to selectively place either the developing device 13 or the developing device 14 to its developing position, so as to enable the copying operation with the black toner or non-black toner.

It is assumed that the apparatus has been stopped in such a state that the black toner is selected, as shown in FIG. 1. In this state, the color developing device 13 takes the retracted position, and therefore, the developing device 13 can be drawn out of the copying apparatus when a front door of the copying apparatus is opened, and in addition, another developing device can be inserted thereinto. However, the black developing device is in its developing position, and therefore, the developing sleeve 14a of the developing device 14 is placed close to the photosensitive drum 11 surface, and in addition, the photosensitive drum 11 is close to the guides 22 and 23, the transfer charger 15 and the separation charger 24. Therefore, if the photosensitive drum 11 or the developing device 14 is drawn out, there is a liability that the surface of the photosensitive drum 11 and the surface of the developing sleeve are damaged. Therefore, in this embodiment, the body B has a stopper 81 so as to prevent the photosensitive drum 11 from being drawn out.

Figure 3:
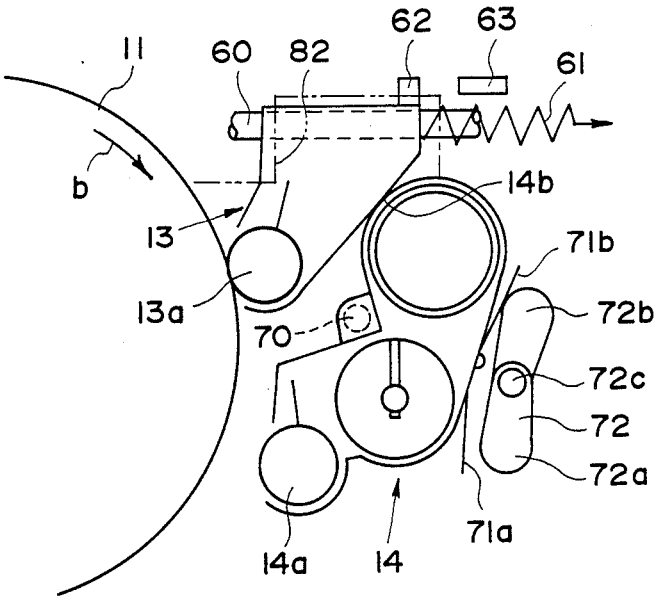
FIG. 3 is a partial sectional view of the apparatus of FIG. 1 when the color developing device 13 is at its developing position.

Then, it is assumed that the apparatus has been stopped under the state that the color toner copying is selected. The elements in the apparatus take such positions as shown in FIG. 3. Since the color developing device 13 is at its developing position close to the photosensitive drum 11. Therefore, if an attempt is made to draw the developing device 13 out of the apparatus, there is a liability that the surface of the photosensitive drum 11 or the developing sleeve 13a is damaged. In order to prevent this, an opening 82 formed in the front wall of the upper body A has a minimum size so that the color developing device 13 can be drawn out only when the color developing device 13 is at the retracted position shown in FIG. 1.

On the other hand, with respect to the mounting or demounting of the black developing device 14, it seems that there is no problem if the developing device 14 is mounted or demounted when it is at such a position away from the photosensitive drum 11 as shown in FIG. 3. However, it is actually difficult since the developing device 14 is acted on by the pressing cam 72 and since the developing device 13 is at the developing position by the urging force from the developing device 14, and therefore, the photosensitive drum 11 can be damaged.

In consideration of these problems, the apparatus according to this embodiment is such that when the upper body A is opened about the shaft 80, the developing devices 13 and 14 assume the positions shown in FIG. 2. More particularly, when the upper body A is opened with the black toner selected (FIG. 1), the pressing cam 72 urging the developing device 14 remains in the lower body B, whereby the developing device 14 held in the upper body A moves upwardly, so that the contact between the developing device 14 and the pressing cam 72 is completely eliminated. The developing device 14 rotates about the pin 70 in the counterclockwise direction by the weight of the developing sleeve 14a through the rotation amount 1 (FIG. 1), until it abuts the rear wall of the color developing device 13.

When, on the other hand, the upper frame A is opened in the state that the color toner is selected (FIG. 3), the black developing device 14, and therefore, the color developing device 13 are released from the urging force of the pressing cam 72, whereby the color developing device 13 is then urged by the spring 61 in the direction away from the drum, and simultaneously, the black developing device 14 is rotated in the clockwise direction about the pin 70, so that the developing device 13 abuts the stopper 63, and therefore, the movements of the both of the developing devices stop.

In this manner, the developing devices 13 and 14 are moved to the positions away from the photosensitive drum, by opening the upper body A from the lower body, and also, they are released from the urging force by the pressing cam 72, whereby the developing device 14 can be demounted or mounted in the state shown in FIG. 2. In the state shown in FIG. 2, the photosensitive drum 11 is released from the stopper 81 so that the developing devices 13 and 14 are spaced from the photosensitive drum 11, and therefore, the photosensitive drum 11 can be replaced in the state shown in FIG. 2. In addition, the developing device 13 is at a position away from the photosensitive drum 11, and therefore, the developing device 13 can be easily mounted or demounted in the state shown in FIG. 2.

According to this embodiment, by closing the upper body A to the lower body B, the developing device 14 is urged by the contact with the pressing cam 72, and when the upper body A is completely closed to the lower body B, the positions of the developing devices are the same as those before the upper body A is closed.

An image forming apparatus according to another embodiment of the present invention will be described.

Figure 4:
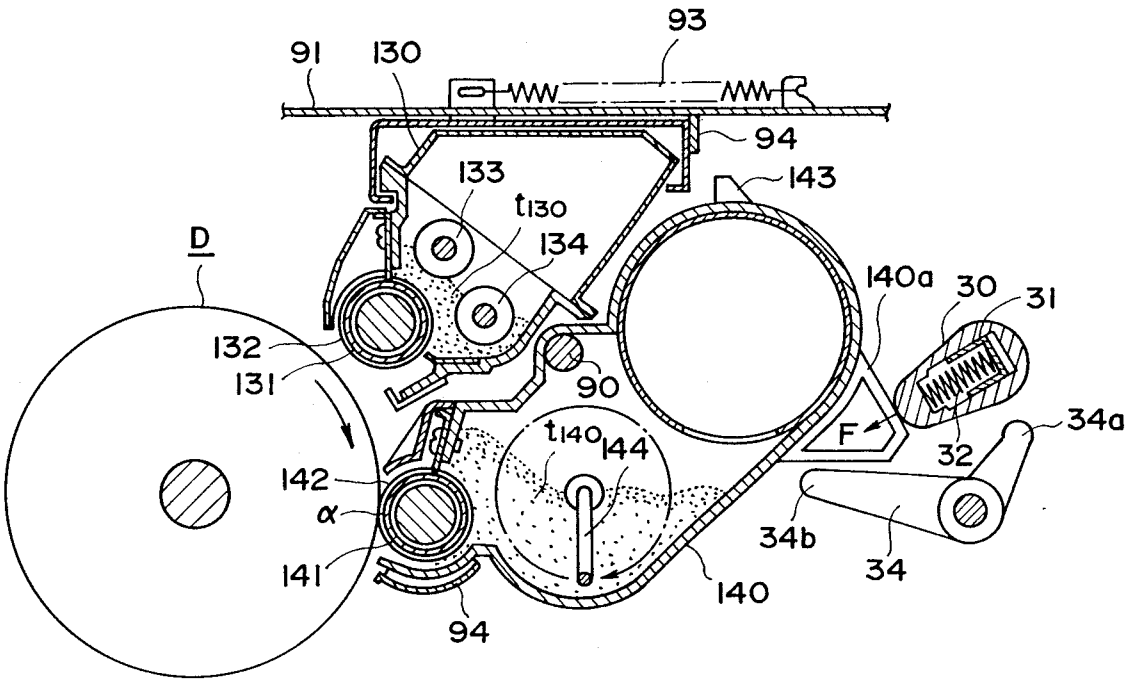
FIG. 4 is a sectional view of a part of an image forming apparatus according to another embodiment of the present invention, wherein a first developing device is held in its developing position.
Figure 5:
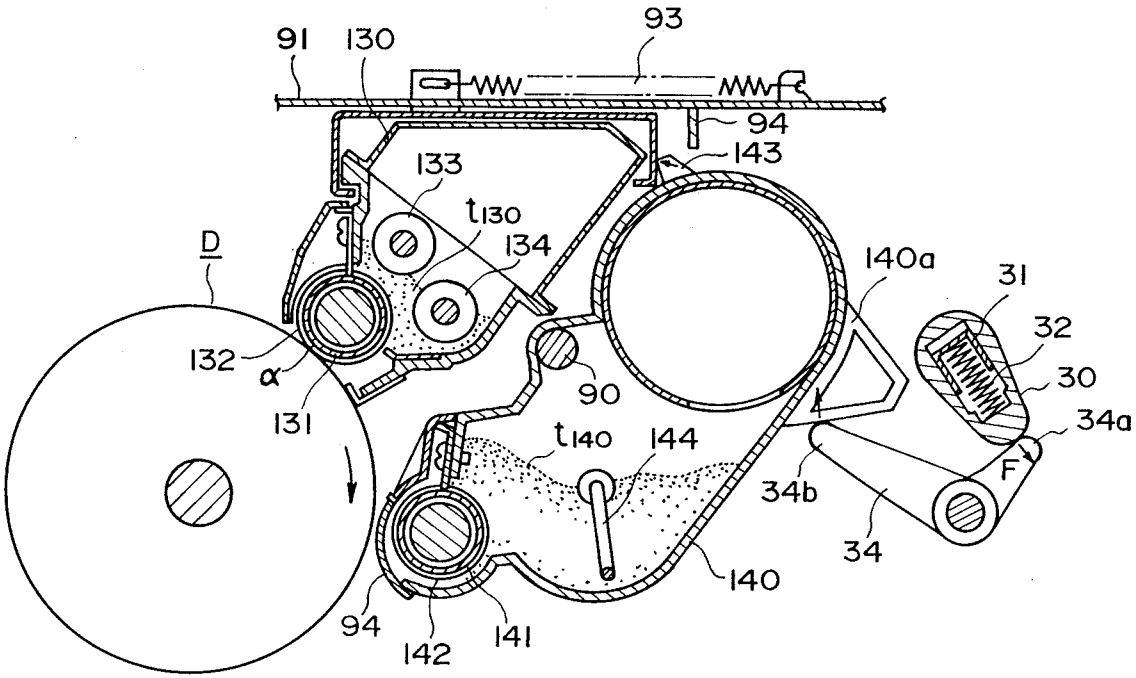
FIG. 5 is a sectional view of the part of the apparatus of FIG. 4 wherein a second developing device is held in its developing position.

Referring to FIG. 4 and FIG. 5, a photosensitive drum (an image bearing member) which is a member to be developed is designated by a reference D. The photosensitive drum D is rotatable in the direction indicated by an arrow at a predetermined peripheral speed. An electrostatic latent image is formed on its peripheral surface by the latent image forming process means described with the first embodiment. Two developing devices, namely, a first developing device 140 and a second developing device 130 are provided, which contain developers (toner) $t_{140}$ and $t_{130}$ which are different in color. In this embodiment, the toner $t_{140}$ is black, while the toner $t_{130}$ is red.

The first developing device 140 is supported on a stay 90 and is swingable about the stay 90 in the clockwise and counterclockwise directions. The second developing device 130 is slidably supported on a supporting member 91 and is slidable therealong toward and away from the photosensitive drum D. The second developing device 130 is normally urged by a tension spring 93 away from the photosensitive drum.

As shown in FIG. 4, the first developing device 140 is at its final position, that is the developing position with respect to the photosensitive drum D, and the second developing device 140 is at its second position, that is, the retracted position. The first developing device 140 is moved to the first position by the operations of the cam 30 (the pressing member) and a cam follower 140*a* (the portion to be pressed), which operations rotate the first developing device in the clockwise direction about the supporting stay 90. In response to this movement of the first developing device 140, the second developing device is moved to its second position. Those operations will be described in more detail hereinafter.

The first developing device 140 has a developing sleeve 141 (developer carrying means), at both ends of which spacer rollers 142 having a diameter larger than that of the developing sleeve are provided. When the first developing device 140 takes the first position, the spacer rollers 142 contact the surface of the photosensitive drum D at the longitudinal marginal portions under a predetermined pressure, so that a small clearance $\alpha$ is formed between the photosensitive drum D and the developing sleeve 141. Thus, the developing sleeve 141 is closely opposed to the surface of the photosensitive drum D, and therefore, the first developing device 140 is capable of developing a latent image on the photosensitive drum D. On the other hand, the second developing device 130 is held at its second position by the force of the tension spring 93 and by the stopper 94. Thus, the developing sleeve 131 is far away from the photosensitive drum D (10–15 mm for example).

In FIG. 5, the first developing device 140 takes the second position, that is, the retracted position, whereas the second developing device 130 takes its first position, namely, the developing position. The first developing device 140 is moved to the second position by the cam 30 (the pressing member) and the lever 34 (the member to be pressed), which rotates the first developing device 140 in the counterclockwise direction about the supporting stay 90. In response to this, the second developing device 130 is moved to its first position by a projection 143 of the first developing device 140, which advances the second developing device 130 toward the photosensitive drum D against the spring force by the tension spring 93.

The mechanism will be described in more detail hereinafter.

Similarly to the first developing device, the second developing device 130 has a developing sleeve 131, at both ends of which spacer rollers 132 having a diameter larger than that of the sleeve 131 are provided. When the second developing device 130 takes its first position, that is, the developing position, the spacer rollers 132 are contacted to the photosensitive drum D at the marginal surfaces under a predetermined pressure, thus forming a fine clearance $\alpha$ with the photosensitive drum D. In this manner, the developing sleeve 131 is closely opposed to the surface of the photosensitive drum D, whereby the second developing device 130 is capable of developing a latent image on the photosensitive drum D. On the other hand, the first developing device 130 held at the second position is far away from the photosensitive drum D (10–15 mm, for example). Simultaneously, in association with the movement away from the photosensitive drum D, a developing sleeve shutter 94 closes, so that the developing sleeve 141 is kept unexposed.

The switching operations of the first and second developing devices 140 and 130 are effected by a mechanism shown in FIGS. 6, 7, 8*a* and 8*b*, which comprises a spring clutch 40 and a solenoid 50, by which the rotational angle of the cam 30 is controlled.

When the first developing device 140 is selected, the solenoid 50 is deenergized, whereas when the second developing device 130 is selected, it is energized.

The operation will be further described.

Figure 6:
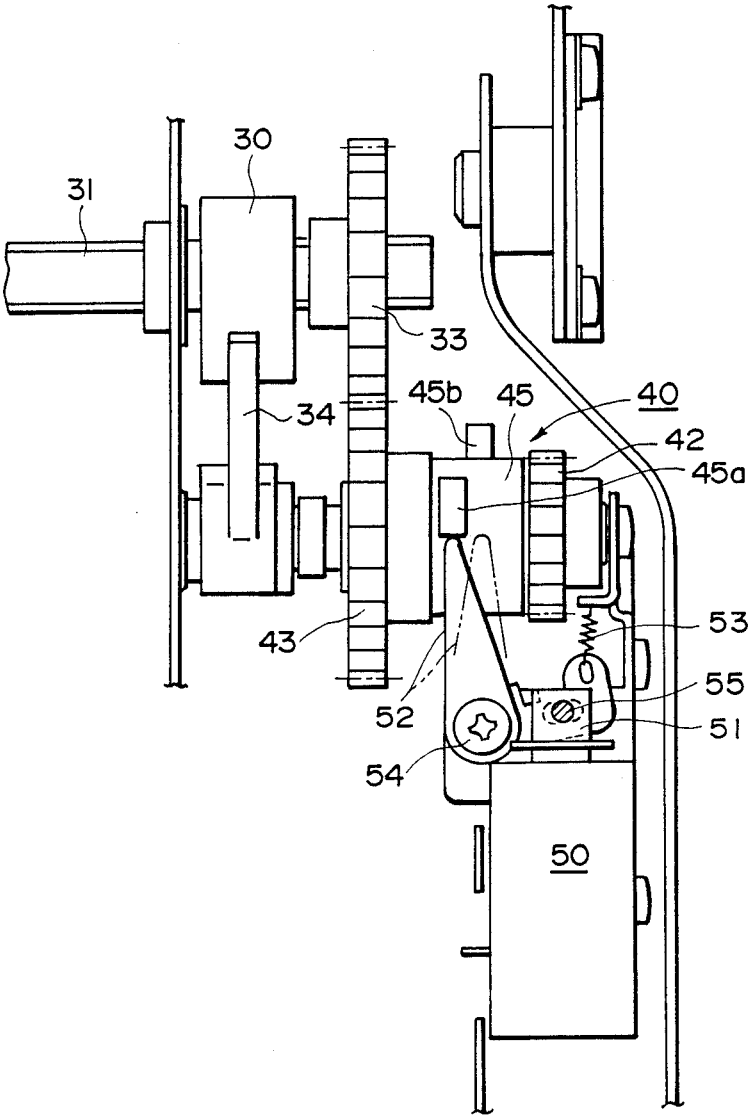
FIG. 6 is a sectional view of a switching and pressing mechanism for a developing device, including a spring clutch and a solenoid.
Figure 7:
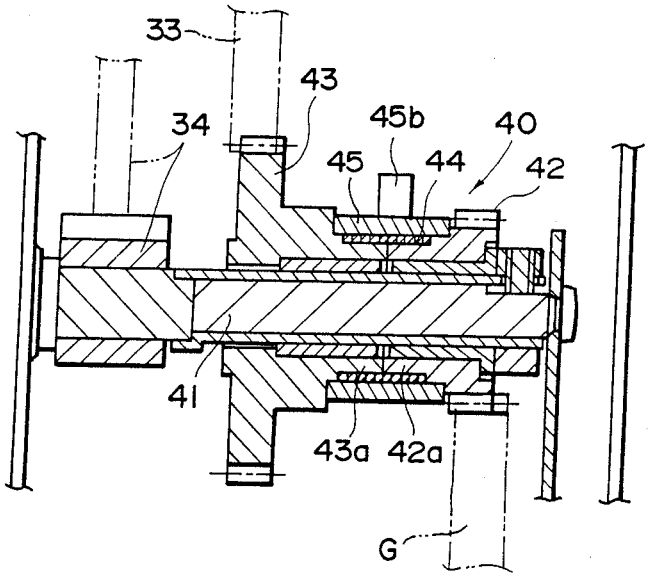
FIG. 7 is a longitudinal sectional view of the spring clutch.
Figure 8B:
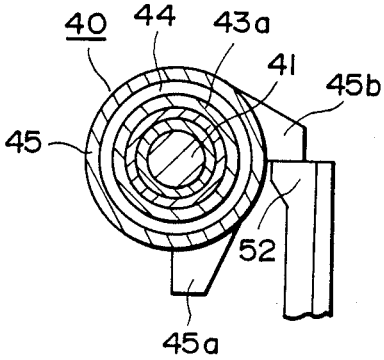
FIGS. 8A and 8B are cross-sectional views illustrating the relation between a pawl of a control ring and a locking lever.
Figure 8A:
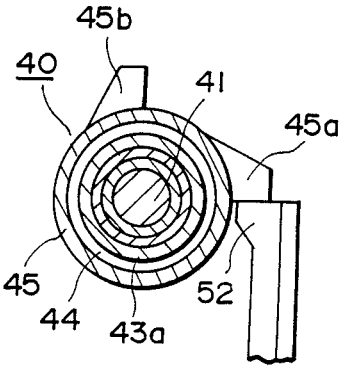

(1) FIG. 6 illustrates the mechanism when the solenoid 50 is not energized, that is, the first developing device 140 is selected. The core 51 of the solenoid 50 is freely movable, and therefore a lever 52 connected to the core 51 is rotated in the counterclockwise direction by a tension spring 53 about a shaft 54 so as to be held at the angular position shown by solid lines. An end of the lever 52 is engaged by a first pawl 45*a* of a control ring 45 of the spring clutch 40 (FIG. 8A), whereby the control ring 45 is stopped. By this engagement, a clutch spring 44 of the clutch is kept in a loose position (clutch disengaging position) around a drum 42*a* connected to a driving gear 42 and also around a drum 43*a* connected to a driven gear 43. Therefore, the driving force transmitted from the driving source gear G to the driving gear 42 is not transmitted to the driven gear 43. A gear 33 meshed with the driven gear 43, a non-round shaft 31 mounted to the gear 33, the cam 30 mounted to the shaft 31, do not rotate, accordingly.

In this state, the cam 30 takes the angular position wherein it is contacted to a cam follower 140*a* of the first developing device 140, as shown in FIG. 4. The pressing force by the cam 30 swings the first developing device 140 about the supporting stay 90 in the counterclockwise direction, so as to move it to the first position. that is, the developing position in association with the photosensitive drum D. The cam 30 is supported on the shaft 31 having a "U" shaped cross-section movable in a direction perpendicular to the axis of the shaft 31, that is the longitudinal direction of the cam 30. The cam 30 is normally urged by a spring within the cam 30 away from the shaft 31. The urging force F of the spring is effective to provide the pressure of 5–6 kg between the spacer rollers 142 and the photosensitive drum D when the first developing device 140 is urged to the photosensitive drum D.

On the other hand, the second developing device 140 is not associated with the first developing device 140 held at its first position. The second developing device 130 is urged and retained at its second position by the spring 93 and the stopper plate 94.

(2) When the second developing device 140 is selected under the above described state, the solenoid 50 is energized. By the energization of the solenoid 50, the core 51 is retracted into the solenoid 50, which rotates the lever 52 against the spring 53 about the shaft 54 so as to move it to the position shown by chain lines. Then, the end of the lever 52 is disengaged from the first pawl 45*a* of the control ring 45 in the clutch 40 so as to allow the control ring 45 to rotate. By this, the clutch spring 45 becomes tight around the drums 42*a* and 43*a* (clutch engaging position), and therefore, the driving force from the driving source gear G is transmitted to the gear 33 through the clutch 40 taking the engaging position. Thus, the non-round shaft 31 and the cam 30 starts rotating in the counterclockwise direction in FIG. 4. At the time when the spring clutch 40 rotates through about 90 degrees in the clockwise direction in FIG. 8A, a second pawl 45*b* of the control ring 45 abuts the end of the lever 52 (FIG. 8B) so that the control ring 45 stops. Then, the clutch spring 44 is shifted to the loose position, by which the transmission of the driving force is disconnected from the gear 33. In association with the 90 degrees rotation of the spring clutch 40, the cam 30 rotates through about 90 degrees in the counterclockwise direction from the angular position shown in FIG. 4, and therefore, takes the angular position shown in FIG. 5. By the rotation process, the cam 30 becomes unassociated from the cam follower 140*a* of the first developing device 140. Following this, the cam 30 is brought into contact with first arm 34*a* of the lever 34 loosely and coaxially supported on a supporting shaft 41 of the spring clutch 40, and therefore, it rotates the lever 34 in the clockwise direction about the supporting shaft 41 from the state shown in FIG. 4. The rotation of the lever 34 brings a second arm 34*b* into contact with the lower surface of the cam follower 140*a* of the first developing device 140, whereby the first developing device 140 rotates about the supporting stay 90 in the counterclockwise direction to the second position. In the process immediately before the first developing device 140 reaches the second position, the developing sleeve shutter 94 is actuated by an unshown mechanism to close the developing sleeve 141.

During the process of the first developing device 140 moving to the second position, the second developing device 130 is pushed by a projection 143 of the first developing device 140, so that it moves to its first position against the spring force by the tension spring 93. Finally, the cam 30 stops at its angular position where it abuts an end of the first arm 34*a* of the lever 34. As a result, the first developing device 140 and the second developing device 130 are shifted to and retained at the second position and the first position, respectively.

The second developing device 130 now assuming its first position is urged to the photosensitive drum D, so that the spacer rollers 132 of the developing sleeve 131 thereof is urged to the photosensitive drum D under the pressure of 5–6 kg, for example, by the spring force F provided by the compressed spring 32 within the cam 30.

(3) When the first developing device 140 is selected again, the solenoid 50 is deenergized.

Then, the iron core 51 becomes freely movable, and therefore, the lever 52 is rotated counterclockwisely about the shaft 54 by the tension spring 53, with the result that the lever 52 restores the angular position shown by the solid line in FIG. 6. By this, the second pawl 45*b* of the control ring 45 is released from the lever 52, thus allowing the control ring 45 to rotate. By this, the clutch spring 44 becomes tight around the drums 42*a* and 43*a* to bring the clutch into the engaging position. Thus, the driving force from the driving source gear G is transmitted to the gear 33 on the non-round gear through the spring clutch 40 in the engaging position, and the shaft 31 and the cam 30 rotate in the counter-clockwise direction from the state shown in FIG. 5.

At the time when the spring clutch 40 rotates through about 270 degrees, the first pawl 45*a* of the control ring 45 engages to the end of the lever 52 now taking the solid line position in FIG. 6, thus bringing the spring clutch 40 into disengaging position, so that the driving force transmission is disconnected to the gear 33. With the rotation of the spring clutch 40 through about 270 degrees, the cam 30 is disconnected from the lever 34 and is restored from the angular position of FIG. 5 to the angular position of FIG. 4 where it is engaged to the cam follower 140*a* of the first developing device 140. As a result the first developing device 140 and the second-developing device 130 are shifted to and retained at the first position and the second position, respectively (the above paragraph (1)).

Figure 9:
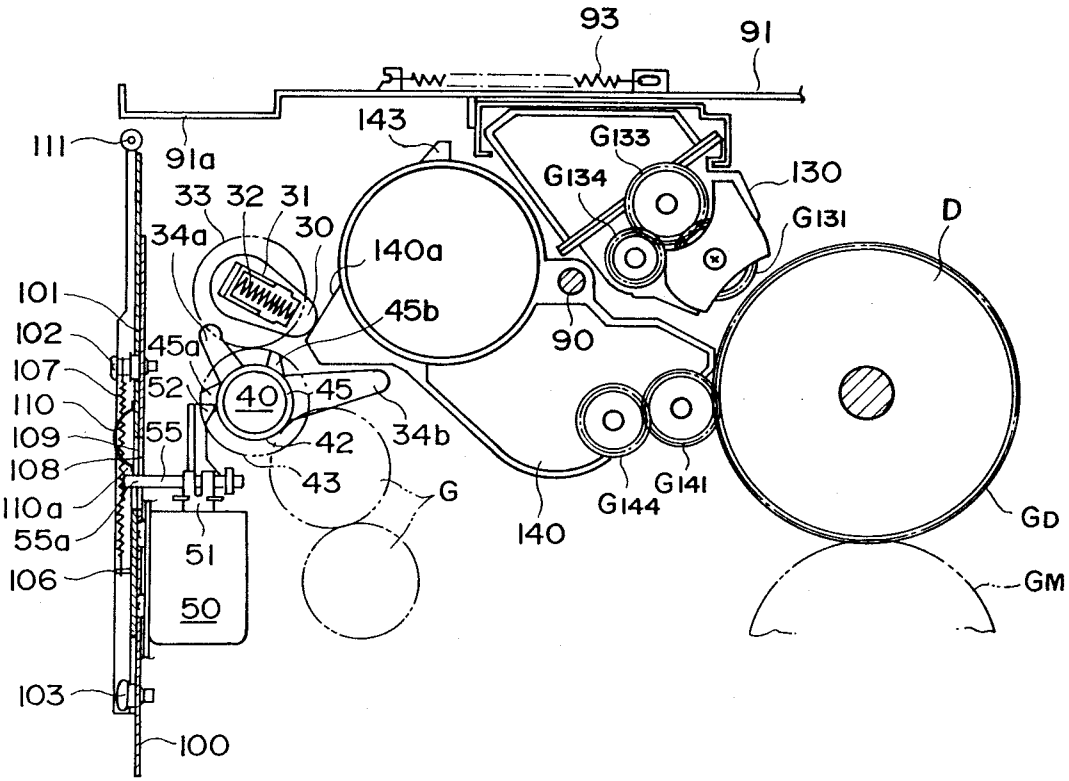
FIG. 9 is a rear view of the mechanism shown in FIG. 4.

FIG. 9 is a rear view of the device of FIG. 4, wherein the reference $G_D$ is a drum gear integral with the photosensitive drum D and is meshed with a driving gear $G_M$. A gear G141 is a gear for driving the developing sleeve 141, and a gear G144 is a gear for driving a developer stirring member 144 and is meshed with the sleeve gear G141. The drum gear $G_D$, and therefore, the photosensitive drum D are driven by the driving gear $G_M$ at a predetermined peripheral speed. The developing sleeve gear G141 is meshed with the drum gear $G_D$ when the first developing device 140 assumes the first position, and the developing sleeve 141 and the developer stirring member 144 of the first developing device 140 are driven in association with the rotation of the photosensitive drum D.

When the second developing device 130 is shifted to and retained at its first position, a developing sleeve gear G131 of the second developing device 130 meshes with the drum gear $G_D$ so that the developing sleeve 131 of the second developing device 130 are driven in association with the photosensitive drum D. Also, by the rotation of the developing sleeve gear G131, gears G133 and G134 for the developer stirring and for conveying members 133 and 134 are driven, whereby the developer stirring and conveying members 133 and 134 are rotated.

On the other hand, the solenoid 50 is stationed supported inside a stationary vertical plate 100. A vertically movable bar 101 is disposed outside the plate 100.

Figure 10:
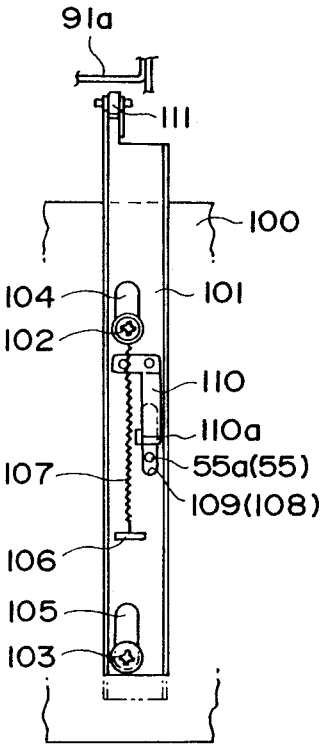
FIG. 10 is a front view of a bar which is vertically movable.

FIG. 10 is a front view of the bar 101. The bar 101 is guided by bushes 102 and 103 on the outer surface of the plate 100 and elongated slots 104 and 105, formed in the bar 101, engage with the bushes 102 and 103, so as to be vertically slidable with respect to the outer side of the plate 100 within the range of the length of the slots 104 and 105. A bent portion 106 is formed in the bar between the slots 104 and 105. A coil spring 107 is tensioned between the bent portion 106 and the upper one of the bushes 102. Therefore, the bar 101 is normally urged upwardly by the spring 107. In the free state (FIGS. 9 and 10), the lever 101 is retained at its uppermost position where the bushes are received by the respective lower ends of the slots.

A pin shaft 55 connecting the iron core 51 of the solenoid 50 and the lever 52 projects outside of the bar 101 through elongated slots 108 and 109 provided corresponding to the plates 100 and the bar 101, respectively, by extending the rear end 55*a* of the pin 55, which is the opposite of the end thereof where it is connected to the lever 52.

A leaf spring 110 is a semi-circular leaf spring and is fixed at its upper end to an outside of the bar 101 at a position above the elongated slot 109 through which the rear end 55*a* projects. A roller 111 is provided at the top of the bar 101. On the other hand, the image forming apparatus is constituted essentially by the upper body and the lower body, which are rotatably openable and closable about a shaft. The upper body and the lower body contain various image forming process means. In this example, the upper body contains the photosensitive drum D, the first and second developing devices 140 and 130, whereas the lower body contains the developing device switching mechanism including the cam 30, the spring clutch 40, the solenoid 50, the vertically movable bar 101 and the like and the developing device pressing mechanism.

The description will be made with respect to the relationship between the opening and closing operations of the image forming apparatus and the developing devices.

(a) FIGS. 4, 5 and 9 illustrate the apparatus when it is closed.

In this state, the bar 101 is free, and therefore, it takes the topmost position and is held there (FIG. 10). The leaf spring 110*a* does not act on the rear end 55*a* of the pin 55.

When the first developing device 140 is selected, the solenoid 50 is deenergized, whereas when the second developing device 130 is selected, it is energized. As described hereinbefore in paragraphs (1)-(3), the first developing device 140 and the second developing device 130 are selectively moved toward the developing positions so as to enabled image formation with the use of the first developing device 140 or with the use of the second developing device 130.

(b) When the image forming device is maintained or serviced, or when the developing device or the photosensitive drum is to be replaced or interchanged, the upper body is opened away from the lower body.

Figure 11:
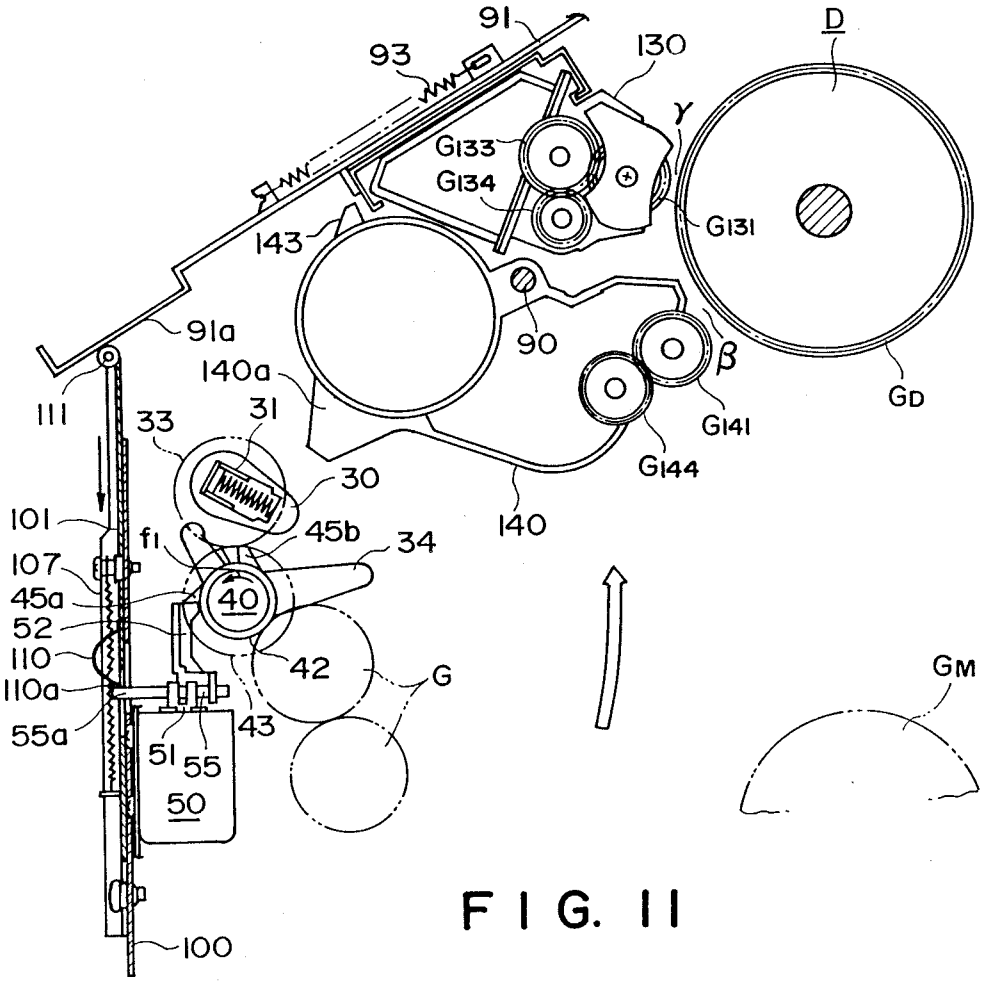
FIG. 11 is a partial rear view of the apparatus wherein the upper body is opened from the lower body.

FIG. 11 illustrates the apparatus when the upper body containing the photosensitive drum D, the first and the second developing devices 140 and 130 is moved to the open position from the closed position shown in FIGS. 4 and 9.

At this time, even if the second developing device 130 takes the first position (developing position) (FIG. 5), it is moved to the second position, while the first developing device is moved to the first position. More particularly, before the upper body is opened, the power supply from the power source is stopped, or a safety switch operates in response to the opening of the upper body, whereby the power supply is automatically shut. Then, the solenoid is deenergized, in response to which the first developing device 140 is moved to its first position (developing position) while, the second developing device 140 is moved to its second position (non-developing position) (FIGS. 4 and 9).

As shown in FIG. 11, when the upper body is opened, the cam follower 140*a* at the first developing device side is released upwardly from the cam of the switching and pressing mechanism contained in the lower body, with the result that it is disconnected from the cam 30. Then, the cam follower 140*a* is released from the pressure, so that the first developing device A which has been retained at the first position, naturally rotates by its own weight about the supporting stay 90 away from the photosensitive drum D, due to the location of the center of the gravity.

In the embodiment, the retracted position is between the above described first position and the second position. In this inbetween retracted position, the projection 143 of the first developing device 140 is close to or contacts the second developing device 130. Even if it is contacted, the pressure of the contact is small, whereby the second developing device 130 is maintained substantially at the second position.

Accordingly, the first and the second developing devices 140 and 130 are held at the retracted positions with proper clearances $\beta$ and $\gamma$ from the photosensitive drum D without contact or contact pressure, as shown in FIG. 11.

Due to the existence of the clearances $\beta$ and $\gamma$, the developing devices and the photosensitive drum do not contact so that the photosensitive drum is not damaged, even if the first developing device 140, the second developing device 130 and or the photosensitive drum D is removed from the upper body.

(c) On the other hand, when the upper body is opened, a member of the upper body, a rear end 91*a* of the supporting member 91 of the second developing device 130, in this embodiment, is brought into contact with the roller 111 at the top end of the vertically movable bar 101 to push the roller 111. By the pressure, the bar 101 is moved downwardly against the coil spring 107. And, the leaf spring 110 integral with the bar 101 is moved down, so that the bottom end 101*a* is brought into contact with the rear end 55*a* of the pin 55, with the result that the pin 55 receives the downward force.

Then, the core 51 of the solenoid 50 is mechanically moved down into the solenoid 50 against the tension spring 53 of the lever 52, in response to which the lever 52 is rotated clockwisely about the shaft 54 (FIG. 6). By the clockwise rotation of the lever 52, the end of the lever 52 is released from the first pawl 45*a* of the control ring of the spring clutch 40, and therefore, it is disengaged from the first pawl 45*a* (FIG. 6, chain line). When the first pawl 45*a* is disengaged from the lever 52, the control ring 45 slightly rotates ($f_1$) in the clockwise direction in FIG. 12A (counterclockwise direction in FIG. 11) by the tightening force of the clutch spring 44. By this, the spring clutch 44 is in the engaging position. Even if the clutch takes the engaging position, the image forming apparatus is not supplied with the power when it is opened. Therefore, the driving gear G does not rotate, and therefore, the mechanisms 43, 33, 31, 30 at the driven side of the spring clutch 40 does not rotate.

(d) When the maintenance or servicing operations is completed, or when the replacement of the developing device or the photosensitive drum is completed, the upper body is closed to the lower body.

Figure 12A:
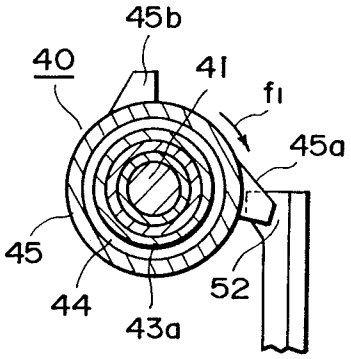
FIGS. 12A and 12B are cross-sectional views of the spring clutch illustrating the relation between the pawl of a control ring and a locking lever when the upper body is opened or closed.
Figure 13:
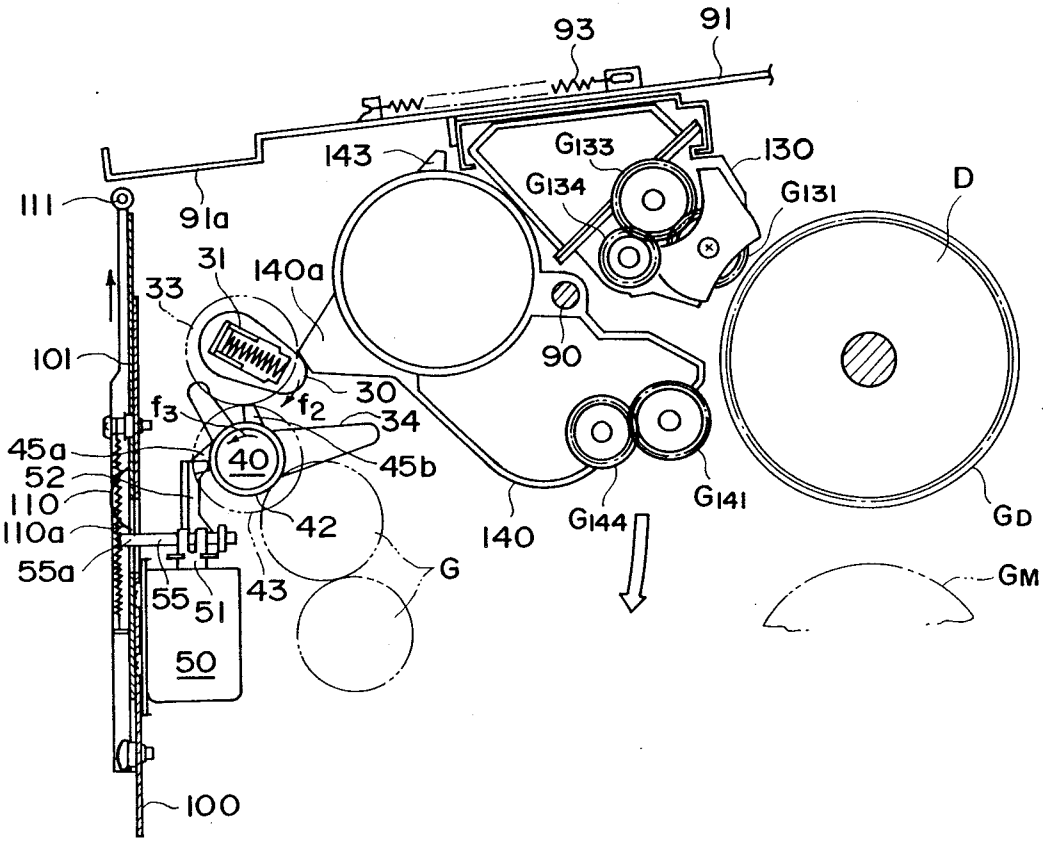
FIG. 13 is a partial rear view of the apparatus wherein the upper body is about to be closed with respect to the lower body.

FIG. 13 illustrates the apparatus which is about to be closed. In this state, the cam follower 140*a* of the first developing device 140 contained in the upper body is engaged to the top side of the cam 30 of the switching and pressing mechanism. With the continued closing action of the upper body, the cam 30 is pushed by the cam follower 140*a*, so that the cam 30 and the shaft 31 rotates clockwisely ($f_2$) in FIG. 13 by the rotation, the control ring 45 of the spring clutch 40 rotates counterclockwisely ($f_3$) in FIG. 13 at a certain degree. The rotation of the control ring 45 is permitted because the first pawl 45*a* of the control ring is disengaged from the lever 52 (FIGS. 11 and 12A).

On the other hand, the member 91*a* is disengaged from the roller 111 at the top of the vertically movable bar 101. Therefore, the bar 101 becomes free, and lifted to the topmost position, and locked and held there. By this, the pin 55 is released from the downward pressure by the lower end 110*a* of the leaf spring 110, so that the core 51 of the solenoid 50 is restored to the projected position by the action of the tension spring 53. Therefore, the lever 52 rotates counterclockwisely about the shaft 54 from the chain line position to the solid line position shown in FIG. 6.

When the top body is completely closed to the lower body, the end of the lever 52 is behind the first pawl 45*a* of the control ring 45 or it is engaged to a side face of the first pawl 45*a* (FIG. 12B), since the control ring 45 of the spring clutch 40 is rotated ($f_3$) by the rotation ($f_2$) provided by the pressure from the cam 30 from the cam follower 140*a* of the first developing device 140 (FIG. 13).

Figure 12B:
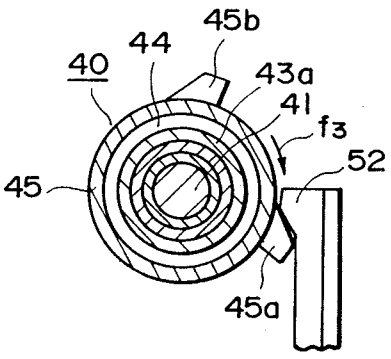

(e) When the upper body is completely closed to the lower body, and the power is supplied, the driving source gear G is driven by a driving gear. When the driving force is transmitted to the driving side gear 42 of the spring clutch 40, the shaft 31 and the cam 30 are rotated through the spring clutch 40 because the end of the lever 52 is disengaged from the first pawl 45*a* and the second pawl 45*b* of the control ring 45 as shown in FIG. 12B and since the clutch is in the engaging position. At the time when the control ring 45 rotates through about 270 degrees in the clockwise direction from the angular position shown in FIG. 12, the first pawl 45*a* abuts the lever 52 and is stopped (FIG. 8A), and therefore, the control ring 45 is stopped to establish the disengaging position of the clutch 40.

Thus, the cam 30 is reset to the position where it is engaged at the predetermined rotational angle to the cam follower 140*a* of the first developing device 140, whereby the first developing device 140 is placed at the first position (developing position) under the predetermined pressure to the photosensitive drum D. If the second developing device 130 is selected thereafter, the solenoid 50 is energized, and as described in the above paragraph (2), the first developing device 140 is shifted away from the photosensitive drum D to its second position, in response to which the second developing device 130 is shifted to its first position (developing position), as shown in FIG. 5.

The photosensitive drum D (the image bearing member) may be contained in the upper body of the image forming apparatus as in the embodiments described hereinbefore, but it may be contained in the lower body.

In the foregoing embodiment, two developing devices are provided in the image forming apparatus, but the present invention is applicable to the case where three or more developing devices are provided for the purpose of full-color or multi-color image formation. The color or other properties of the developers contained in the developing devices may be determined as desired.

The mechanism for moving or shifting or switching, the developing devices is not limited to those of the above described embodiments, but one skilled in the art may employ another mechanism without departing from the scope of the present invention.

As described above, according to the present invention, the developing devices are shifted away from the image bearing member when the openable body is opened, irrespective of which ever developing device is selected. Therefore, the opening or closing operation of the image forming apparatus can be performed without the possibility of damaging the image bearing member and/or the developing sleeve. Therefore, if the apparatus is of the type wherein the developing device is mountable or demountable, the demounting or mounting operation is easy, thus increasing the service life of the total image forming apparatus.

Further, according to the present invention, there is provided a resetting mechanism whereby when the opened image forming apparatus is closed, the developing device and the means actable on the developing device which are separately contained in the upper body and the lower body are not misaligned but are correctly aligned, and therefore, the developing device is reset stably to the predetermined position with respect to the image bearing member under a predetermined pressure.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus including a first body and a second body which is openable from and closable to said first body, said image forming apparatus comprising in said first or second body:

a movable image bearing member;

means for forming a latent image on said image bearing member in accordance with image information;

at least first and second developing means for developing the latent image formed on said image bearing member by said latent image forming means, each of said first and second developing means being movable between a developing position for developing the latent image on said image bearing member and a retracted position where it is retracted from the developing position and disposed away from said image bearing member;

first moving means for moving said first developing means between its developing position and its retracted position when the second body is closed, wherein said second developing means is movable between its developing position and its retracted position when the second body is closed and inversely to said first developing means, in response to said first moving means moving said first developing means between its retracted position and its developing position; and second moving means for moving away from said image bearing member at least the developing means in its developing position when the second body is closed without moving the developing means that is at its retracted position to its developing position, in response to an opening operation of the second body.

2. An image forming apparatus according to claim 1, wherein said first and second developing means contain different color developers.

3. An image forming apparatus according to claim 1, wherein said first and second bodies are openable about a shaft, and wherein said second body is opened upwardly from said first body.

4. An image forming apparatus according to claim 3, wherein said first and second developing means are contained in said second body, and wherein said first and second developing means are moved upwardly together with the opening of the second body.

5. An image forming apparatus according to claim 1, said first moving means being contained in said first body, wherein engagement between said developing means and first moving means is released by the opening between said first body and second body, and wherein at least the developing means that takes its developing position is moved away from said image bearing member in response to the opening of the second body from said first body.

6. An image forming apparatus according to claim 1, further comprising urging means for urging said second developing means in a direction away from said image bearing member, wherein said first moving means moves said second developing means to its developing position against said urging means.

7. An image forming apparatus according to claim 6, wherein said second developing means is moved from its retracted position to its developing position by said first developing means directly pressing said second developing means in association with said moving means moving said first developing means from its developing position to its retracted position.

8. An image forming apparatus according to claim 5, wherein said image bearing member, said first developing means and said second developing means are contained in said second body.

9. An image forming apparatus according to claim 1, wherein said first moving means is operative commonly to move said first developing means and said second developing means.

10. An image forming apparatus according to claim 1, wherein a developing operation of each of said developing means is stopped when situated at the retracted position.

11. An image forming apparatus including a first body and a second body which is openable from and closable to said first body, said image forming apparatus comprising in said first or second body:

a movable image bearing member;

means for forming a latent image on said image bearing member in accordance with image formation;

at least first and second developing means for developing the latent image formed on said image bearing member by said latent image forming means, each of said first and second developing means being movable, when the second body is closed, between a developing position for developing the latent image on said image bearing member and a retracted position where it is retracted from the developing position and disposed away from said image bearing member;

first moving means for moving away from said image bearing member at least the developing means in its developing position when the second body is closed without moving the developing means that is at its retracted position to its developing position, in response to an opening operation of the second body; and means for establishing, in response to a closing operation of the second body, positions of said first and second developing means which are the same as those prior to the second body being opened.

12. An image forming apparatus according to claim 11, further comprising second moving means for moving said first developing means between its developing position and its retracted position, wherein said second developing means is movable between its developing position and its retracted position inversely to said first developing means, in response to said moving second means moving said first developing means between its retracted position and its developing position.

13. An image forming apparatus according to claim 12, further comprising urging means for urging said second developing means in a direction away from said image bearing member, wherein said second moving means moves said second developing means to its developing position against said urging means.

14. An image forming apparatus according to claim 13, wherein said second developing means is moved from its retracted position to its developing position by said first developing means directly pressing said second developing means in association with said second moving means moving said first developing means from its developing position to its retracted position.

15. An image forming apparatus according to claim 12, wherein engagement between said first developing means and said second moving means is released by the opening of said second body from said first body, and wherein with the opening of the second body, at least the developing means that is located at its developing position is moved away from the image bearing member.

16. An image forming apparatus according to claim 15, wherein said moving means is contained in said first body.

17. An image forming apparatus according to claim 12, wherein said second moving means is operative commonly to move said first developing means and said second developing means.

18. An image forming apparatus according to claim 17, wherein a developing operation of each of said developing means is stopped when situated at the retracted position.

19. An image forming apparatus including a first body and a second body which is openable from and closable to said first body, said image forming apparatus comprising in said first or second body:

a movable image bearing member;

means for forming a latent image on said image bearing member in accordance with image information;

at least first and second developing means for developing the latent image formed on said image bearing member by said latent image forming means, each of said first and second developing means being movable between a developing position for developing the latent image on said image bearing member and a retracted position where it is retracted from the developing position and disposed away from said image bearing member, wherein when the second body is closed, one of said first and second developing means is at its developing position, and the other developing means is in its retracted position;

first moving means for moving away from said image bearing member at least the developing means in the developing position when the second body is closed without moving the developing means that is at its retracted position to its developing position, in response to an opening operation of the second body; and means for always setting said first developing means in said developing position after an opening and closing of said second body.

20. An image forming apparatus according to claim 19, said first developing means is more frequently used than said second developing means.

21. An image forming apparatus according to claim 20, wherein said first developing means contains a black developer.

22. An image forming apparatus according to claim 19, wherein after said second body is closed to the first body and after said apparatus is supplied with power, said first developing means is always set to the developing position.

23. An image forming apparatus according to claim 19, further comprising second moving means for moving said first developing means between its developing position and its retracted position when the second body is closed, wherein said second developing means is movable between its developing position and its retracted position when the second body is closed and inversely to said first developing means, in response to said second moving means moving said first developing means between its retracted position and its developing position.

24. An image forming apparatus according to claim 23, further comprising urging means for urging said second developing means in a direction away from said image bearing member, wherein said second moving means moves said second developing means to its developing position against said urging means.

25. An image forming apparatus according to claim 24, wherein said second developing means is moved from its retracted position to its developing position by said first developing means directly pressing said second developing means in association with said moving means moving said first developing means from its developing position to its retracted position.

26. An image forming apparatus according to claim 23, wherein engagement between said first developing means and said second moving means is released by the opening of said second body from said first body, and wherein with the opening of the second body, at least the developing means that is located at its developing position is moved away from the image bearing member.

27. An image forming apparatus according to claim 19, wherein a developing operation of each of said developing means is stopped when situated at the retracted position.

28. An image forming apparatus according to claim 24, wherein said second moving means is contained in said first body.

29. An image forming apparatus according to claim 24, wherein said second moving means is operative commonly to move said first developing means and said second developing means.

* * * * *

UNITED STATES PATENT AND TRADEMARK OFFICE

CERTIFICATE OF CORRECTION

PATENT NO. : 4,896,193

DATED : January 23, 1990

INVENTOR(S) : KAZUO KAGIURA, ET AL.

It is certified that error appears in the above-identified patent and that said Letters Patent is hereby corrected as shown below:

COLUMN 1

Line 39, "desire" should read --desired--.

COLUMN 6

Line 6, ". Therefore," should read --; therefore,--.

COLUMN 7

Line 28, "final" should read --first--.
Line 30, "second developing device 140" should read --second developing device 130--.

COLUMN 8

Line 20, "first developing device 130" should read --first developing device 140--.

COLUMN 9

Line 4, "second developing device 140" should read --second developing device 130--.
Line 22, "starts" should read --start--.
Line 65, "is" should read --are--.

COLUMN 10

Line 52, "are" should read --is--.
Line 59, "sup-" should be deleted.
Line 60, "ported" should be deleted.

UNITED STATES PATENT AND TRADEMARK OFFICE

CERTIFICATE OF CORRECTION

PATENT NO. : 4,896,193

DATED : January 23, 1990

INVENTOR(S) : KAZUO KAGIURA, ET AL.

It is certified that error appears in the above-identified patent and that said Letters Patent is hereby corrected as shown below:

COLUMN 11

Line 47, "to enabled" should read --to enable--.

COLUMN 12

Line 2, "device 140" should read --device 130--.
Line 56, "clutch spring 44." should read --spring clutch 44.--.
Line 62, "does" should read --do--.
Line 63, "is" should read --are--.

COLUMN 13

Line 6, "rotates clockwisely" should read --rotate clockwise-- and "FIG. 13 by" should read --FIG. 13. By--.

COLUMN 15

Line 55, "image formation;" should read --image information;--.

COLUMN 16

Line 16, "moving second" should read --second moving--.
Line 47, "17," should read --11,--.

UNITED STATES PATENT AND TRADEMARK OFFICE

CERTIFICATE OF CORRECTION

PATENT NO. : 4,896,193

DATED : January 23, 1990

INVENTOR(S) : KAZUO KAGIURA, ET AL.

It is certified that error appears in the above-identified patent and that said Letters Patent is hereby corrected as shown below:

COLUMN 17

Line 15, "said first developing means" should read --wherein said first developing means--.

Signed and Sealed this

Twenty-fifth Day of August, 1992

*Attest:*

DOUGLAS B. COMER

*Attesting Officer*

*Acting Commissioner of Patents and Trademarks*